United States Patent [19]

Cumming et al.

[11] 4,194,232

[45] Mar. 18, 1980

[54] ION TREATMENT OF PHOTOGRAPHIC FILM

[76] Inventors: James M. Cumming, 4571 Comber Ave., Encino, Calif. 91316; Donald G. Saurenman, 6787 Worsham Dr., Whittier, Calif. 90602

[21] Appl. No.: 892,139

[22] Filed: Mar. 31, 1978

[51] Int. Cl.[2] ..... H05F 3/04; H01T 19/04

[52] U.S. Cl. ..... 361/213; 15/1.5 R; 361/214; 361/230

[58] Field of Search ..... 361/213, 214, 220, 229, 361/230; 15/306 R, 306 A, 306 B, 310, 316 R, 1.5 R

[56] References Cited

U.S. PATENT DOCUMENTS

| | | | |
|---|---|---|---|
| 3,128,492 | 4/1964 | Hanscom et al. | 15/1.5 R |
| 3,156,847 | 11/1964 | Schweriner | 361/230 |
| 3,308,343 | 3/1967 | Smith et al. | 361/213 |
| 3,475,652 | 10/1969 | Levy | 361/213 |
| 3,619,719 | 11/1971 | Waller et al. | 361/230 |
| 3,643,128 | 2/1972 | Testone | 361/230 |
| 3,644,953 | 2/1972 | Christiansen | 15/1.5 R |
| 4,048,667 | 9/1977 | Brennecke | 361/213 |

*Primary Examiner*—J. D. Miller
*Assistant Examiner*—L. Schroeder
*Attorney, Agent, or Firm*—William W. Haefliger

[57] ABSTRACT

Opposite sides of film slides are efficiently cleaned by employing voltage energized needle tips to distribute ions into gas streams that flow within a venturi-shaped zone through which the film slides are passed.

28 Claims, 6 Drawing Figures

ION TREATMENT OF PHOTOGRAPHIC FILM

BACKGROUND OF THE INVENTION

This invention relates generally to treatment of photographic film, and more particularly concerns removal of dust from film slide surfaces as well as elimination of static on such surfaces, so as to remove dust from film.

In the past, devices have been constructed which employ nuclear pellets to ionize air which is blasted over film slides. The cost of such equipment is objectionable, in view of the need for frequent replacement of the nuclear pellets, which are individually expensive.

SUMMARY OF THE INVENTION

It is a major object of the present invention to provide apparatus and method to overcome the above problems and heavy expense. Basically, the apparatus comprises:

(a) a support, (b) means associated with the support defining a film treatment zone in the shape of recess having a front opening and opposite side openings which are laterally spaced apart, and through which film may be laterally passed, (c) means for supplying streams of gas to the zone and closely adjacent opposite faces of the film passing laterally through the treatment zone, and (d) means for effecting delivery of ions to come in contact with the opposite faces of the film passed through the zone, said means including needles to which voltage is supplied.

As will be seen, a yoke may be provided to removably seat on the support, the yoke having depending arms, and the needles carried by said arms, and additional means, to supply high voltage to said needles at a level or levels to effect production of ions distributed to neutralize static on film or a film slide passed through said zone, is provided.

Furthermore, since the ionization strength depends only on the voltage of house current available, there is no deterioration with time. Also, the ions are concentrated in essentially a knife-like or planar pattern or patterns, for best results.

Further favorable results are obtained by controlling or periodically changing the polarity of the ions being distributed, the polarity change for example being effected at an alternation frequency of 60 cycles per second. Also, the optimum voltage application and the ions are typically generated at the tips of a row of needles, the peak voltage applied to the needles being between 3,500 and 5,500, for best results. The needles are typically arrayed in a row along the bottom of an elongated narrow recess in each arm, the structure being such as to minimize the chance of shocking the hand of an operator, despite needle end exposure.

A modified apparatus distributes pressurized gas and ions at the throat of a venturi shaped recess, and the supply of gas is minimized through provision of a control responsive to slide insertion into the recess.

These and other objects and advantages of the invention, as well as the details of illustrative embodiments, will be more fully understood from the following description and drawings, in which:

DRAWING DESCRIPTION

DETAILED DESCRIPTION

Figure 1:
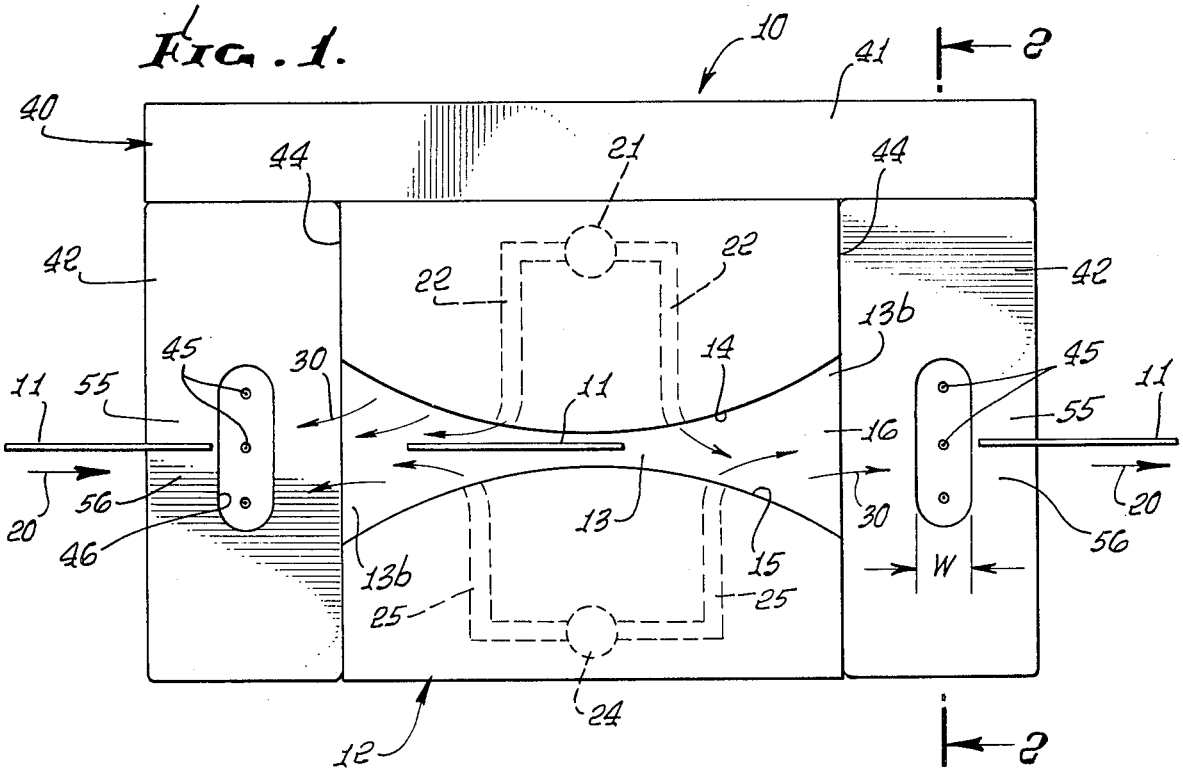
FIG. 1 is an end elevation of apparatus incorporating the invention.
Figure 2:
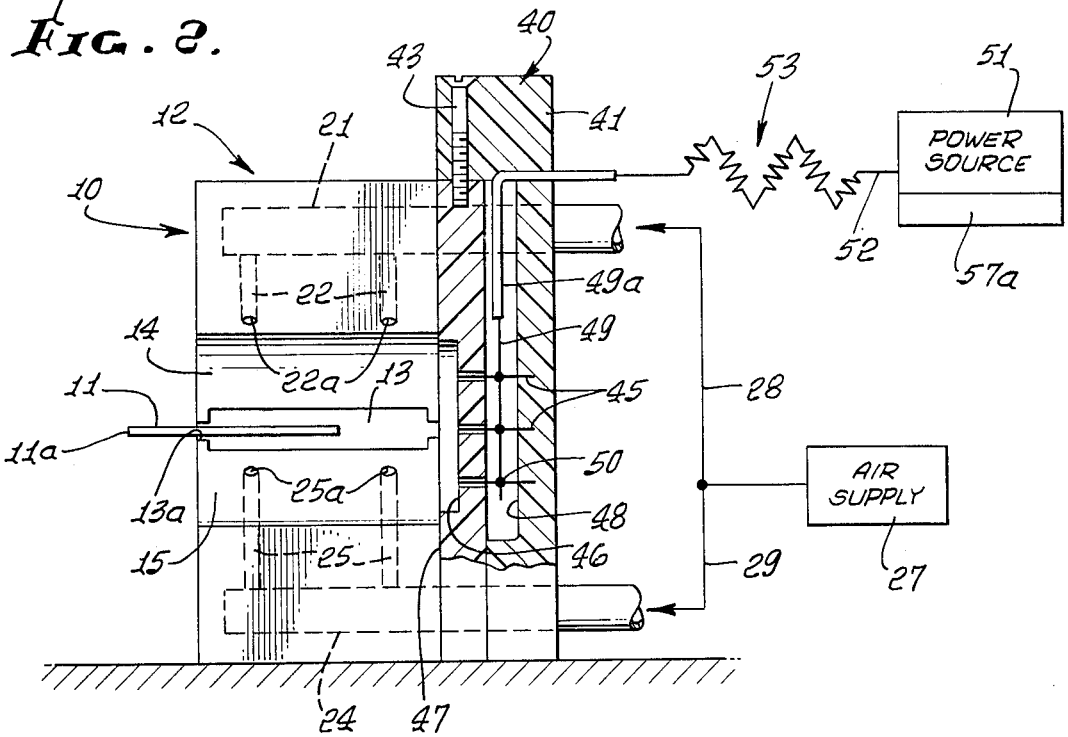
FIG. 2 is a side elevation on lines 2—2 of FIG. 1.
Figure 3:
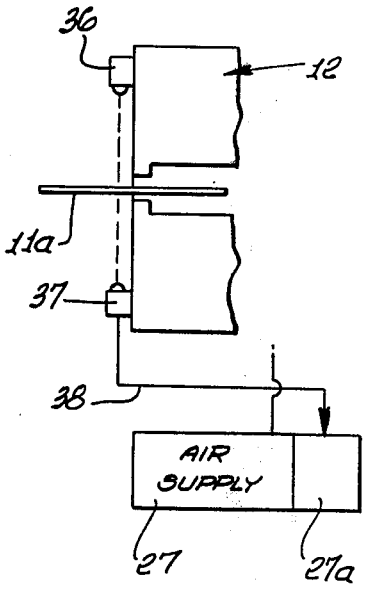
FIG. 3 is a fragmentary side elevational view, showing a modification.

In FIGS. 1-3, the apparatus 10 for treating photograhic film slides 11 includes a support 12 and means associated with the support defining a film slide treatment zone 13 in the shape of a recess having a front opening 13*a* and opposite side openings 13*b*. The latter are spaced apart laterally to pass the film slides through the zone 13 which typically has venturi shape as seen in FIG. 1. Such means may comprise upper and lower curved surfaces 14 and 15. Surface 14 is downwardly convex in end elevation as seen in FIG. 1. Surface 15 is upwardly convex in end elevation as seen in FIG. 1. A support or body wall 16 closes the rear side of recess 13.

Means is also provided to supply streams of pressurized gas such as air or nitrogen to zone 13, and closely adjacent opposite faces of slide 11 passing laterally through the treatment zone. See in this regard the slide travel direction indicated by arrows 20 in FIG. 1. Such means may include the upper ducts 21 and 22, in the support body above zone 13, and the lower ducts 24 and 25 in the body below zone 13. A compressed air supply such as a pump is indicated at 27, with hose lines 28 and 29 leading to main ducts 21 and 24 as indicated. Outlets from the branch ducts 22 and 25 appear at 22*a* and 25*a* facing a throat portion of zone 13. Accordingly, dust is swept off the upper and lower sides of the film slides as they pass through the zone 13. The gaseous streams tend to flow laterally beyond the recess ends 13*b* in FIG. 1, as indicated by arrows 30. Note in FIG. 2 the protruding end portion 11*a* of the film which may be finger gripped to pass it through the recess 13 in the directions of arrows 20.

FIG. 3 shows a photoelectric beam 35 directed downwardly from a beam generator 36 to a detector 37, at the front of the support 12. Upon interruption of the beam, as by entry of the slide into recess or zone 13, an air supply motor 27*a* is activated, to drive the air supply pump (for example) whereby air is automatically supplied to zone 13 only when the slide is in zone 13. An electrical connection from detector 37 to the motor 27*a* is indicated at 38.

Also provided is means for effecting delivery of ions to auxiliary zones adjacent to the treatment zone or recess 13, opposite its ends 13*b*, thereby to come into contact with the opposite (i.e. upper and lower) faces of the film slide passed through zone 13. In the drawings, such means advantageously includes a yoke 40 carried by the support 12, the yoke including a cross-piece 41 extending over the rear of the support and depending arms 42 extending downwardly as shown, adjacent opposite ends 44 of the support. The yoke may be releasably seated on the support, so as to be removable as and when desired. Further, the yoke may consist of insulative plastic material. Fasteners 43 are shown attaching the cross-piece to the depending arms.

The means to effect ion delivery also includes needles 45 carried by the arms, the needles embedded in the arms and having exposed tips located in and near the bottom of a vertically elongated recess 46 sunk in each arm, whereby the needle tips extend in vertical rows.

The depth of each recess from arm front face 47 may be about 2–3 mm. The recess width "w" is preferably sufficiently narrow that a user's finger placed against the front face 19 and over the recess does not protrude into the recess far enough to contact any of the needles. This safety feature prevents electrical shocking by the needles, to which high voltage (between 3,500 and 5,500 volts) is normally applied. At the same time, no screen is then needed to cover the recess. Such a screen would interfere with the outward flow of ions required to treat, i.e. electrically neutralize, the slide. The width "w" is less than 10 mm, for best results, and preferably about 7 mm.

The needles also project within a cavity 48 sunk in the arm 42 and of a length greater than the length of recess 46. Accordingly, the metallic, electrically conductive needles can easily be joined to a bus wire 49 as at locations 50 in the cavity. Wire 49, sheathed at 49*a*, extends through the arm and is supplied with high voltage from a source 51, via cable 52 and resistor 53, which may be controlled.

The high voltage applied to the needles results in the production of ions which are carried by the air streams from zone 13 to sweep against the opposite sides of the slides, and also to auxiliary zones 55 and 56 above and below the slides at the ends of zone 13, neutralizing static on the slides and also sweeping dust off the slide surfaces, the amount of air and quantity of ions being such as to achieve this purpose. In this regard, best results are achieved when the peak voltage above zero applied to the needles is between 3,500 and 5,500 volts. The voltage at the output of source 51 may be at a higher level (as for example 12,000 volts) which is then reduced by a resistor or staggered array of resistors 53. The latter may be configured for optimized performance. It has been observed that the use of the resistor array produces voltage spikes which enhance performance. One usable voltage source is described in U.S. Pat. No. 3,308,344, although others may be used, including an AC source. The polarity of the voltage may also be changed or alternated between positive and negative as by appropriate circuitry, indicated for example at 57*a*. The polarity change may be at 60 cycles per second, for very good results.

The location of the resistor or resistors should be close to the needles, for best results. Power supply 51 may be remote from the support 12 and from the resistors.

The basic method of use includes the steps:

(a) passing the slide laterally through a treatment zone defined by a recess having a front opening and opposite side openings which are laterally spaced apart, (b) delivering streams of gas to said zone and against opposite faces of said slide as the slide is passed laterally through said zone, and (c) delivery ions to auxiliary zones adjacent to said treatment zone opposite side openings thereby to come in contact with said opposite faces of the film slide passed through said zone, the ions delivered from ion sources that include needle tips.

Figure 4:
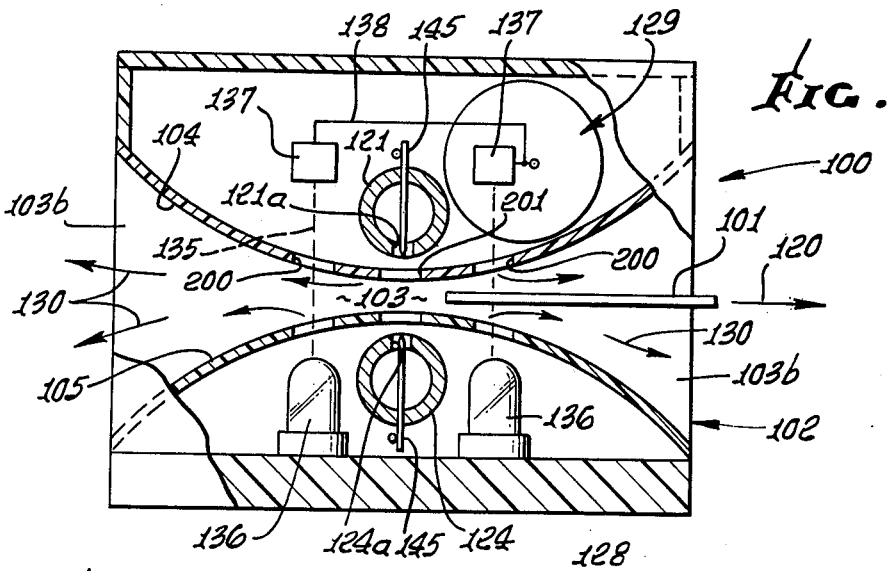
FIG. 4 is a view like FIG. 1, showing modified apparatus.
Figure 5:
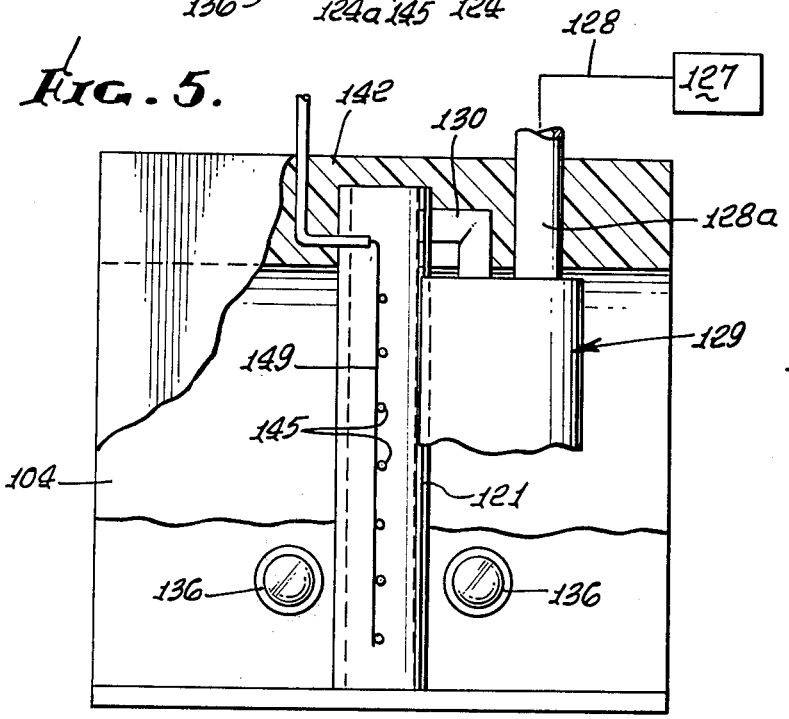
FIG. 5 is a top plan view of the FIG. 4 apparatus.
Figure 6:
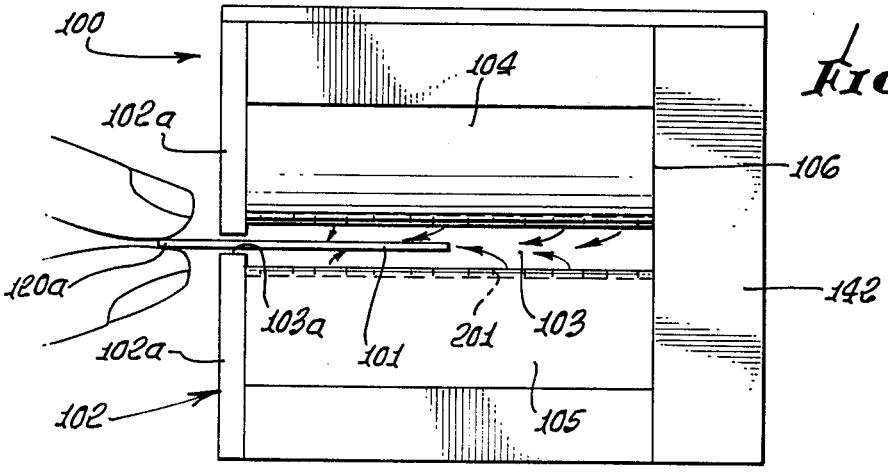
FIG. 6 is an end elevation of the FIG. 4 apparatus.

In FIGS. 4–6, the apparatus 100 for treating photographic film 101 includes a support 102 and means associated with the support defining a film treatment zone 103 in the shape of a recess having a front opening 103*a* and opposite side openings 103*b*. the latter are spaced apart laterally to pass the film such as through the zone 103 which typically has venturi shape as seen in FIG. 4. Such means may comprise upper and lower curved surfaces 104 and 105. Surface 104 is downwardly convex in elevation as seen in FIG. 4. Surface 105 is upwardly convex in end elevation as seen in FIG. 4. A support or body wall 106 closes the rear side of recess 103. Front opening 103*a* is reduced to about slide thickness to block escape of pressurized gas, frontwardly. Walls 102*a* form slot 103*a*.

Means is also provided to supply streams of pressurized gas such as air or nitrogen to zone 103, and closely adjacent opposite faces of slide 101 passing laterally through the treatment zone. See in this regard the slide travel direction indicated by arrows 120 in FIG. 4. Such means include the upper tube or duct 121 in the support body above zone 103, and the lower duct 124 in the body below zone 103. A compressed air supply such as a pump is indicated at 127, with lines 128 and 128*a*, solenoid controlled valve 129, and lines 130 leading to main ducts 121 and 124 as indicated. Lines 128, 128*a* and 130 are in wall 142. Outlets from ducts 121 and 124 appear at 121*a* and 124*a*, these being located at opposite sides of the venturi throat. Accordingly, dust is swept off the upper and lower sides of the film slides as they pass through the zone 103. The pressurized gaseous streams tend to flow laterally and at lesser velocity beyond the recess openings 103*b* in FIG. 4, as indicated by arrows 130. Note in FIG. 6 the protruding end portion 120*a* of the film which may be finger gripped to pass it through the recess 103 in the direction of arrows 120.

FIG. 4 shows photoelectric beams 135 directed upwardly from a beam generators 136 to detectors 137 within the support 102, the beams crossing zone 103 at opposite sides of the openings 124*a*. Support wall openings appear at 200 for the beams and at 201 for the gas. Upon interruption of either beam, as by entry of the slide into recess or zone 103 from either direction, the solenoid valve 129 is activated, to pass the compressed gas to ducts 121 and 124, but only when the slide is in zone 103. An electrical connection from detector 137 to the solenoid valve 129 is indicated at 138.

Also provided is means for effecting delivery of ions to the treatment zone 103 thereby to come into contact with the opposite (i.e. upper and lower) faces of the film slide passed through zone 103.

The means to effect ion delivery includes needles 145 carried by the ducts 121 and 124, the needles embedded in the plastic ducts and having exposed tips located in the openings 121*a* and 124*a*.

The metallic, electrically conductive needles can easily be joined to bus wires 149 as at locations outside the ducts. Wire 149, is supplied with high voltage from a source as described in FIGS. 1–3.

The high voltage applied to the needles results in the production of ions which are carried by the air streams to sweep against the opposite sides of the slides, neutralizing static on the slides and also sweeping dust off the slide surfaces, the amount of air and quantity of ions being such as to achieve this purpose. In this regard, best results are achieved when the voltage applied to the needles is between 3,500 and 5,500 volts, positive or negative a neutralization of the static requires. The polarity of the voltage may also be changed or alternated between positive and negative as by appropriate circuitry.

The compressed gas supply is minimized by locating the gas ports out the venturi throat, for maximum velocity, and also by using the beams 135 as described.

This new cleaner is particularly successful in cleaning films mounted on cardboard by the customer as well as slides and strips of film. The latter are available in 3" or 5" widths, especially for professional labs that never before have had an effective, labor saving cleaning device for use with cut film. Accordingly, any such film shall be considered as included within the term photographic "slides" used herein.

We claim:

1. In the method of treating a film including cleaning of the film, the steps that include (a) passing the film laterally through a treatment zone defined by a recess having a front opening and opposite side openings which are laterally spaced apart, said zone having a narrower region between said side openings;

(b) delivering streams of pressurized gas to said narrower region of said zone and directed toward and against opposite faces of said film as the film is passed laterally through said region, and so that the film faces are swept first in one direction with gas and then in the opposite direction as the film passes through said zone, (c) delivering ions to auxiliary zones adjacent to said treatment zone opposite side openings thereby to come in contact with said opposite faces of the film passed through said zone.

2. The method of claim 1 including the step of periodically changing the polarity of said ions being delivered to said auxiliary zone.

3. The method of claim 2 wherein said polarity change is effected 60 times per second.

4. The method of claim 1 wherein said ions are delivered from a row of ion sources proximate each of said auxiliary zones, said row defining a plane which is generally normal to the direction of film passage through said treatment zone.

5. The method of claim 4 wherein said sources are defined by needles with tips oriented to effect said delivering of ions, said gas consisting of air.

6. The method of claim 5 including supplying an alternating voltage to said needles, the maximum voltage above zero level being between 3,500 and 5,500 volts.

7. The method of claim 5 including supplying voltage to said needles, the voltage maximum being between 3,500 and 5,500.

8. The method of claim 7 including generating maximum voltage substantially above 5,500 volts, and reducing said maximum voltage, near said needles, to be supplied thereto, to between 3,500 and 5,500 volts.

9. The method of claim 7 that includes providing a support with means thereon defining said recess, providing a yoke on which said needles are carried, and supporting said yoke on said support.

10. In apparatus for treating a film combination comprising (a) a support, (b) means associated with the support defining a film treatment zone in the shape of a recess having a front opening and opposite side openings which are laterally spaced apart, and through which film may be laterally passed, (c) means for supplying streams of gas to said zone and closely adjacent opposite faces of the film passing laterally through said treatment zone, and (d) means for effecting delivery of ions to come in contact with said opposite faces of the film passed through said zone, said means including tips to which voltage is supplied, (e) said treatment zone being generally venturi shaped between said opposite side openings, said means for supplying streams of gas including ducting having discharge ports facing a throat portion of said zone.

11. The combination of claim 10 including a yoke on said support, said yoke having depending arms, and said needles carried by said arms, and additional means to supply high voltage to said tips at a level or levels to effect production of ions distributed to neutralized static on the film passed through said zone.

12. The combination of claim 11 where said voltage is between 3,500 and 5,500, maximum.

13. The combination of claim 11 wherein said means to supply voltage includes circuitry to supply alternating voltage at a maximum level of between 3,500 and 5,500 above and below zero.

14. The combination of claim 12 wherein said voltage supply means includes circuitry to generate maximum voltage substantially above 5,500 volts, and resistors in series to reduce said maximum voltage, near said tips, to between 3,500 and 5,500.

15. The combination of claim 11 wherein each of said arms has an elongated recess sunk therein, said tips located near the bottom of the recess, the tips defined by needles spaced in a row lengthwise of the recess.

16. In apparatus for treating a film the combination comprising (a) a support, (b) means associated with the support defining a film treatment zone in the shape of a recess having a front opening and opposite side openings which are laterally spaced apart, and through which film may be laterally passed, (c) means for supplying streams of gas to said zone and closely adjacent opposite faces of the film passing laterally through said treatment zone, and (d) means for effecting delivery of ions to come in contact with said opposite faces of the film passed through said zone, said means including tips to which voltage is supplied, (e) there being a yoke on said support, said yoke having depending arms, and said tips carried by said arms, and additional means to supply high voltage to said tips at a level or levels to effect production of ions distributed to neutralized static on the film passed through said zone, (f) each of said arms having an elongated recess sunk therein, said tips located near the bottom of the recess, the tips spaced in a row lengthwise of the recess, (g) said zone extending horizontally and having an enlarged mouth at each end thereof, said arms extending vertically adjacent said mouths, the tips facing auxiliary zones adjacent said mouths.

17. In apparatus for treating film and employing, (a) a support, (b) means associated with the support defining a film treatment zone in the shape of a recess having a front opening and opposite side openings which are laterally spaced apart, and through which film may be laterally passed, said recess being generally venturi shaped between said opposite side openings, and (c) means for supplying streams of gas to a throat portion of said zone and closely adjacent opposite faces of the film passing laterally through said treatment zone, the improvement comprising:

(d) means for effecting delivery of ions to auxiliary zones adjacent to said treatment zone opposite side openings, for contacting said opposite faces of the film passed through said zone, said means including tips to which voltage is supplied.

18. The apparatus of claim 17 wherein said last named means includes a yoke configured to removably seat on said support, the yoke having depending arms, said tips carried by said arms, and additional means to supply high voltage to said tips at a level or levels to effect production of ions distributed to neutralize static on the film passed through said zone.

19. In apparatus for treating a film the combination comprising (a) a support, (b) means associated with the support defining a film treatment zone in the shape of a recess having a front opening and opposite side openings which are laterally spaced apart, and through which film may be laterally passed, (c) means for supplying streams of gas to said zone and closely adjacent opposite faces of the film passing laterally through said treatment zone, and (d) means for effecting delivery of ions to come in contact with said opposite faces of the film passed through said zone, said means including tips to which voltage is supplied.

(e) said treatment zone having venturi shape between said opposite side openings, said means for supplying streams of gas including ducting having discharge ports facing said treatment zone, said tips located proximate said ports.

20. The combination of claim 19 wherein said means defining said treatment zone includes opposed generally convex walls at opposite sides of said zone and facing the interior thereof, said discharge ports located proximate said walls to jet said gaseous streams into a constricted portion of said zone from opposite sides thereof.

21. The combination of claim 20 wherein said tips are located at discharge ports proximate both said walls.

22. The combination of claim 21 wherein said means to supply gas includes tubing proximate said walls but outside said zone, the tubing defining said ports.

23. The combination of claim 19 including means to enable said (c) means in response to insertion of film into said zone.

24. The combination of claim 19 including means to produce beams at opposite sides of said ports to enable said (c) means in response to insertion of film into said zone from either end thereof.

25. The method of claim 1 including the step of providing positive polarity ions delivered to said zone.

26. The method of claim 1 including the step of providing negative polarity ions delivered to said zone.

27. The combination of claim 23 wherein said means includes a photoelectric beam generator and a beam detector in the path of the beam which is located to be interrupted in response to said film insertion.

28. The method of claim 1 including controlling said gas stream delivery to said narrower region of the venturi shaped zone to initiate same only in response to entry of the film into said region.

* * * * *